US006296582B1

(12) United States Patent
Minniear

(10) Patent No.: US 6,296,582 B1
(45) Date of Patent: Oct. 2, 2001

(54) BASEBALL STRIKING PRACTICE DEVICE

(76) Inventor: Timothy Minniear, 1031 Prospect Pl., Vista, CA (US) 92083

( * ) Notice: Subject to any disclaimer, the term of this patent is extended or adjusted under 35 U.S.C. 154(b) by 0 days.

(21) Appl. No.: 09/430,373

(22) Filed: Oct. 29, 1999

(51) Int. Cl.[7] ..... A63B 69/00

(52) U.S. Cl. ..... 473/428; 473/423; 473/422; 473/429

(58) Field of Search ..... 473/420–430; 273/331, DIG. 26, 334, 335

(56) References Cited

U.S. PATENT DOCUMENTS

| | | | | |
|---|---|---|---|---|
| 3,006,647 | * | 10/1961 | Haskett | 473/429 |
| 3,166,316 | * | 1/1965 | O'Leary | 473/427 |
| 3,550,937 | * | 12/1970 | Wright | 473/427 |
| 4,322,075 | * | 3/1982 | Hynes | 473/427 |
| 4,815,735 | * | 3/1989 | McClenny | 473/427 |
| 4,966,367 | * | 10/1990 | Oyarzabal | 473/429 |
| 5,244,392 | * | 9/1993 | Maursetter | 473/429 |
| 5,340,101 | * | 8/1994 | Lawson et al. | 473/429 |
| 5,460,380 | * | 10/1995 | Ober | 473/423 |
| 5,683,315 | * | 11/1997 | Ring | 473/429 |
| 5,766,102 | * | 6/1998 | Lawson et al. | 473/428 |
| 5,776,017 | * | 7/1998 | Brawn | 473/426 |
| 5,882,270 | * | 3/1999 | Daugherty | 473/427 |

* cited by examiner

*Primary Examiner*—Jeanette Chapman
*Assistant Examiner*—Mitra Aryanpour
(74) *Attorney, Agent, or Firm*—Donn K. Harms

(57) ABSTRACT

A ball hitting practice device featuring a practice ball slidably located upon a tether. The tether is attached to a support structure thereby placing the practice ball in a target position to be hit by a user. The support structure may be mounted to a base, driven into the ground, or attached to a wall. The ball is slidably mounted to the tether and is positioned in a target position for striking by a user by a ball positioner also located on the tether in a fixed position that is either adjustable or permanent. Once struck during use, the practice ball and attached tether wrap around the support structure and may be aided in the return to the target position by an elongated biasing device attached to the distal end of the tether and the support structure or another fixed point of attachment. An optional cam may be used to adjust the radius of a vertical post of the support structure thereby allowing the user to alter the return speed of the ball to the target position by adjusting the cam. The tether may also act as the elongated biasing device in one embodiment of the device.

18 Claims, 3 Drawing Sheets

BASEBALL STRIKING PRACTICE DEVICE

BACKGROUND OF THE INVENTION

1. Field of the Invention

This invention relates to a ball striking practice device. More particularly it relates to a device which enables a user to practice repetitively striking a practice ball locatable on a tether to one of a plurality of vertically preset locations, resulting in a realistic resistance and flight of a stuck ball and a quick controlled return of the object to the same location for re-striking. The distance of the practice ball from the user and the ground is adjustable by adaptation of the pole structure used to mount the ball tether or by adjustment of the mounting of the ball on the tether.

2. Prior Art

Ball striking practice devices are commonly used in the United States and throughout the world to improve one's skill in games which involve the striking of an object such as a baseball, softball, tennis ball, hand ball, racket ball with a striking instrument such as racket, bat stick, or one's hand, which most such practice ball striking positioning devices have failed to duplicate the normal striking position of the user or a realistic feel and flight of a ball, namely a pitched object when impacted.

Others have been deficient because of their complexity or have been expensive for purchase by young ball players. Or, they lack features to prevent dangerous return movement of the ball after it is hit or to return the ball in a hitting position with a simulated pitching motion. Furthermore, the development of batting skills is currently accomplished with the use of costly pitching machines and batting drills utilizing pitchers at some risk to the latter. Hitting practice requires a substantial open area to avoid risk to other players. Accordingly, hitting practice is often limited by lack of space, pitching machines and/or pitchers to throw for batting practice.

U.S. Pat. No. 4,027,880 to Adke teaches a tennis ball attached to a combination of horizontal elastic and inelastic cords which necessarily require the striker to straddle one of the cords, thus preventing practice on a high positioned practice ball.

U.S. Pat. No. 4,088,316 to SZAFIANSKI retrains the struck object along only one axis, in this case the vertical axis. There is a substantial danger that the return flight of the ball will fly directly toward the striker. If the ball is hard, like a baseball, injury can result.

U.S. Pat. No. 2,270,957 to MEARS is also restrained along a single axis, requires attachment to a permanent structure, and although the resistance may be varied by movement of the person, does not permit motion of a static resistance to the struck ball. Additionally, this device does not provide the ability to selectively position the ball along the vertical axis for different strokes.

Tethered apparatus such as U.S. Pat. No. 4,576,379 to Juhasz, U.S. Pat. No. 4,462,599 to Brown, U.S. Pat. No. 4,216,960 to Nicfolls, and U.S. Pat. No. 1,708,796 to Lawrence all merely suspend a ball from a tether but do not provide the feel, flight, safety, nor any control on the speed of return of the ball and dampening advantages of the present invention.

US. Pat. No. 5,048,828 to Love, provides a batting practice device although safe, adjustable in height and cost-effective but uses two non-elastic rope materials as tethers. The dampening delays caused by the rope resistance during its winding and unwinding motion do not provide the player the feel, flight nor the simulation of a ball projected by centrifugal forces similar to a pitched ball by a pitcher nor the device has any features for controlling the speed of return of the ball as advanced in the present invention.

U.S. Pat. NO. 5,135,219 to Mceon et al. teaches a baseball batting practice using two tethered ropes, one snugly lined by a metal tube. With the same problems of dampening and delays than Love, the practice device also does not provide any control on the speed of return of the ball.

U.S. Pat. No. 5,340,101 to Lawson et al. teaches a training apparatus using a fence and a series of cable clamps to tie-down the apparatus arms to the fences. Such practice devices are restricted to outdoor places that necessarily have fences and where noise and accuracy of the ball's position at return due to the effect of the fence vibrations are not important to the player. The device has not the advantages of feel, flight, safety and controls of the present invention.

There thus exists the need for a batting practice device that provides safety of use, and for improved hand and eye coordination of players, which can be used in a confined space by containing the travel of the ball. The ball movements should closely simulate real conditions of balls pitched by a pitcher and an adjustable system of control of the speed of return, and adjustment of target height, thus providing a manner for accelerating and improving the learning process into more advanced levels.

SUMMARY OF THE INVENTION

Applicant's device provides the user with a manner to practice batting their batting technique and in various embodiments may be portable or permanently mounted depending on the intended use. The device features a practice mountable slidably locateable to an infinite number of positions on a tether depending on where a tether mounted ball positioner is located. The practice ball thereby will still slide upward toward its attachment to a horizontal post while being prevented from sliding past the positioner.

The device features a selectively permanent mountable or portable stand, which when in use, has a base portion, a generally vertical post or riser portion and a horizontal top portion.

A practice ball is for provided for the user which in the current best mode, is slidably located on a tether in the appropriately spaced relationship of ball from the ground and from the user which is generally determined by the user height. During use, the ball is suspended vertically from anchoring means provided at the extension end of the horizontal top arm using a tether means and a ball positioner to maintain the ball in a target position for hitting and then returning it thereto after being struck.

The tether in the current best mode is made from an elastic material similar to that used on surf board leashes as it possesses the elastic and exterior smooth surface properties desired for an optimum leash. The practice ball is slidably located in the hitting position by a positioner attached to the tether. In use the tether provides a smooth exterior surface for the practice ball to slide and to relocate while being strong enough to absorb continual spiral wrapping around the upright post or vertical riser.

The vertical riser and the horizontal arm may be fixed in length, or, as in the current best mode, one or both may have telescoping members of adjustable length means so that the tether and the vertical position of the practice ball may be conveniently adjusted to the user's height or stance and the mode of practice intended.

The tether as such, provides a means to locate the ball in the correct or target position for hitting by adjustment of the attached poles and optionally, the positioner thereon. Practice may be conduced in a confined area since when the practice ball is struck, the tether stores the kinetic energy of the ball like that of a twisted spring and returns the ball to the original target position. Additional biasing to return to the hitting or target position is provided by a second tether which may be attached to the distal end of the tether below the ball, to the ball positioner below the practice ball, or may be part of the first tether and just continue to a mounting on the pole.

Additional utility is provided by another optional feature of another embodiment of the invention in the form of a means for adjustment of ball return speed that the device can be quickly adjusted to the level of skills of a player by adjusting quickly the device to control the speed of return of the ball. This return means adjustment is accomplished in one of two ways. In the first and simplest manner the speed of the return may be adjusted by providing a second lower tether or leash which provides a biasing means with more or less bias depending on the biasing material used. By using an elastic cord of increasing strength as the second tether, the return of the ball may be sped up and conversely slowed by using a cord with less bias. In another embodiment of the device, return speed characteristics are adjustable by an axially off-centered enclosure like a pipe, that rotates similarly to a cam and that readily adjusts the distance around which the tether will wrap and unwrap itself around it.

In the current best embodiment herein disclosed the striking instrument will be referred to as a bat and the struck object as a baseball, both of the type commonly used in the game of baseball, although many variations of the striking and struck object could be used.

Muscle memory occurs when a particular motion is repeated a sufficient number of times with accompanying realistic sensations to verify the proper execution of the motion so as to enable a person to precisely reenact the motion when called upon in a competitive setting. In actual competition the feel of striking a ball, the flight of the ball, and the location of landing of the ball, all verify the proper execution of the striking motion. In a game such as baseball, a number of motions are required as a result of the location and speed of the reception of the baseball. Each motion is accompanied by different sensations imparted when striking the ball.

It is therefor an object of this invention, to provide a ball striking practice device for improving one's skill in games which involve the striking of an object such as a baseball, softball, tennis ball, hand ball, racket ball with a striking instrument such as racket, bat stick, or one's hand.

It is an additional object of the invention herein, to provide a permanent or portably mountable practice device which permits a person to engage in the repetitive striking of a ball or similar object at a plurality of preset vertical position and a plurality of preset speed of returns of the practice ball.

A further object of this invention is to provide such ball striking practice ability in a relatively confined location so as to tone the required muscles, develop muscle memory of the proper motion, and develop the proper execution of the striking motion.

Another object of the present invention is to provide a device to permit hitting the ball from a normal striking position to stimulate realistic resistance and flight of the ball after being struck, and return the ball quickly to substantially the same location where it was struck.

An additional object is to provide the capability of adjusting the vertical location of the practice ball to permit practice of the basic motions in baseball as well as to adjust to different heights of players.

A further objective is to precisely orient the ball to minimize undesirable contact between the periphery of the striking instrument and the securing tethers and insure consistent feel and flight of the ball.

Yet another objective is to provide a rapid means of adjustment of the speed of return of the ball for either speeding the practice process, improving hand and eye coordination, and accelerating the learning process for more advanced levels of the pitching practice.

Further objects and advantages of the invention will be readily apparent to those skilled in the art from the following detailed description, taken in conjunction with the annexed sheets of drawings on which is shown a preferred embodiment of the invention, wherein detailed description is for the purpose of fully disclosing the invention without placing limitations thereon.

BRIEF DESCRIPTION OF DRAWING FIGURES

Figure 2:
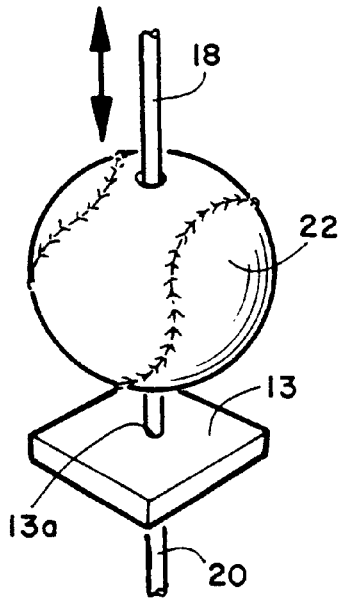
FIG. 2 is a view of the ball slidably located on the tether using a slot through the ball and the ball positioner.
Figure 2A:
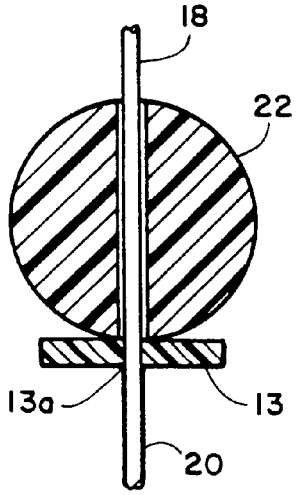

FIG. 2*a* depicts a cut away view of the ball showing the slot therethrough.

Figure 2B:
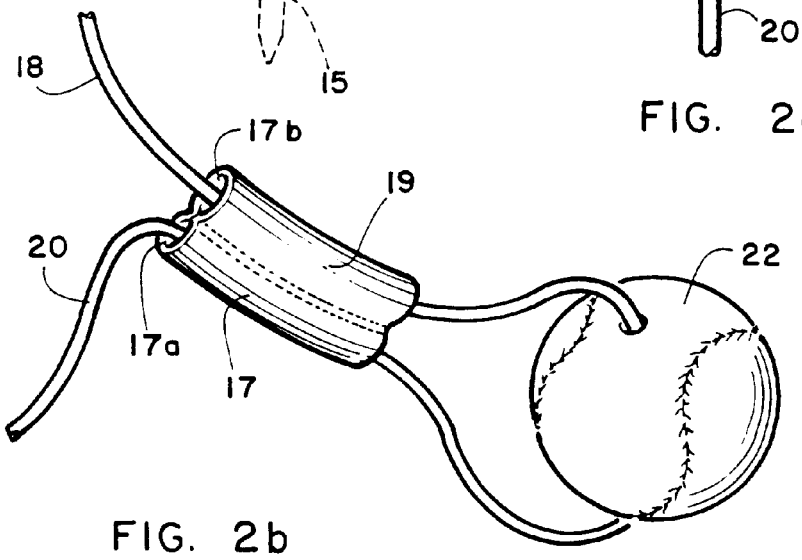

FIG. 2*b* depicts a different form of the ball positioner forming a loop on the tether.

Figure 3:
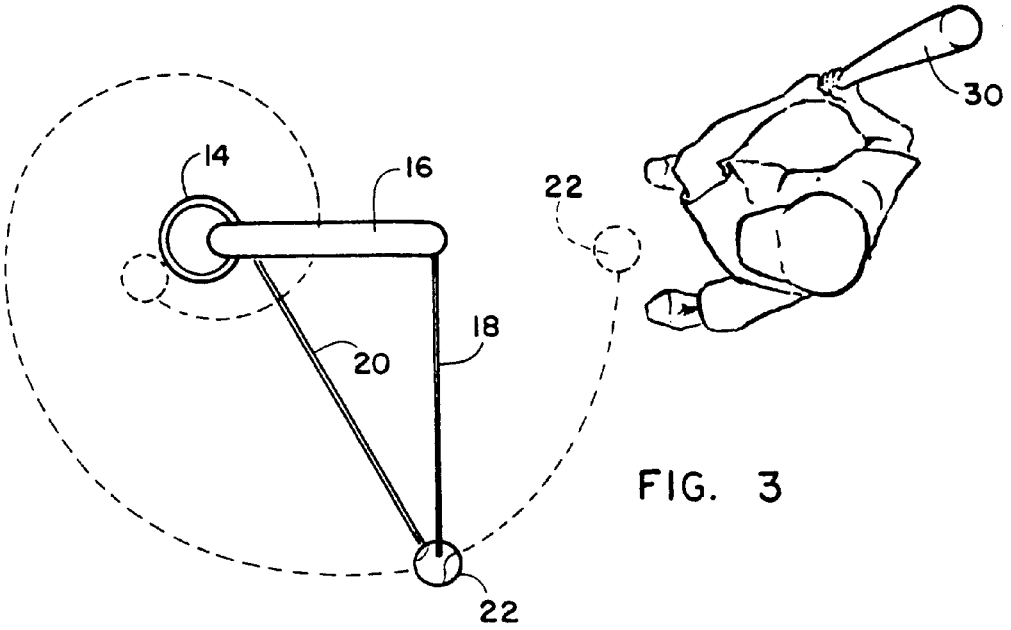

FIG. 3 is a top plan view of a batter using the practice device and illustrating the spiral path of the ball.

Figure 4:
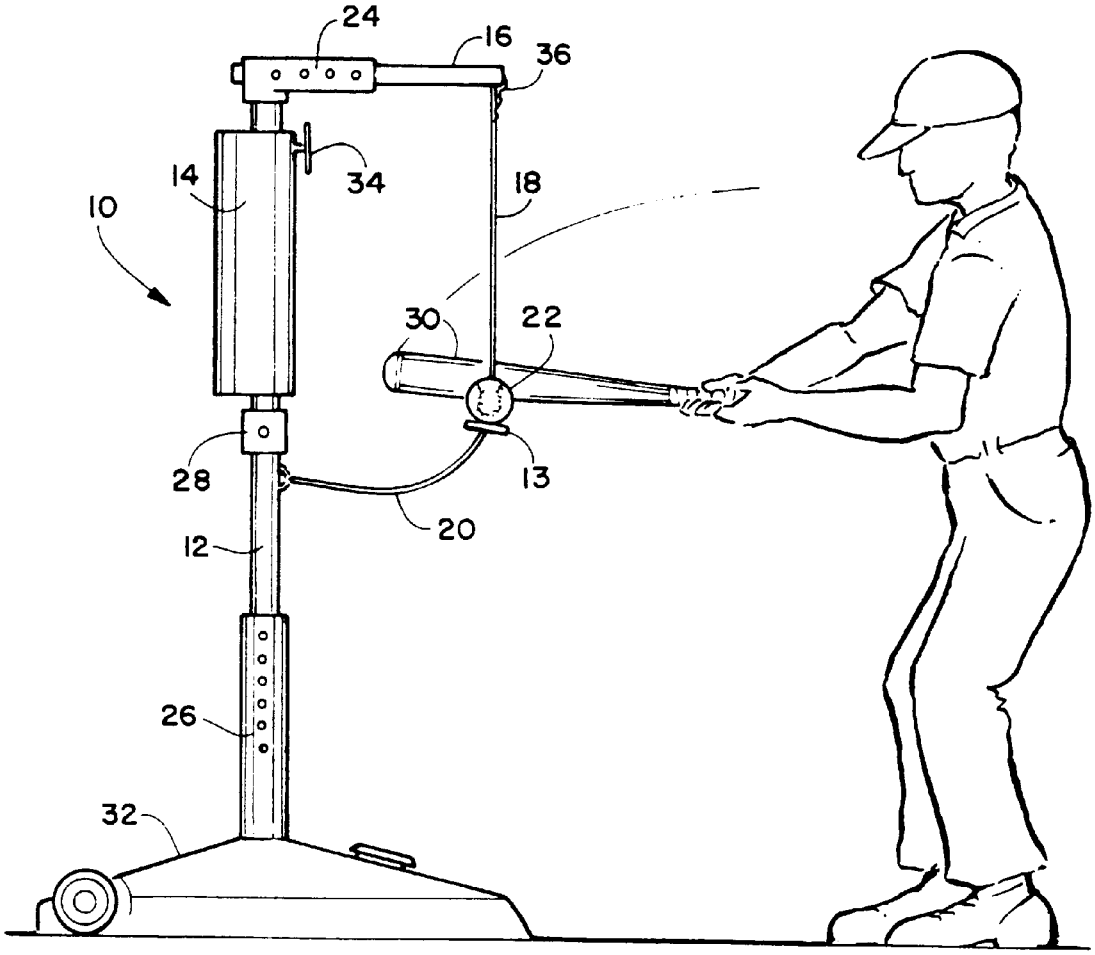

FIG. 4 is a side view of the device with the user hitting the ball in a target position.

Figure 5:
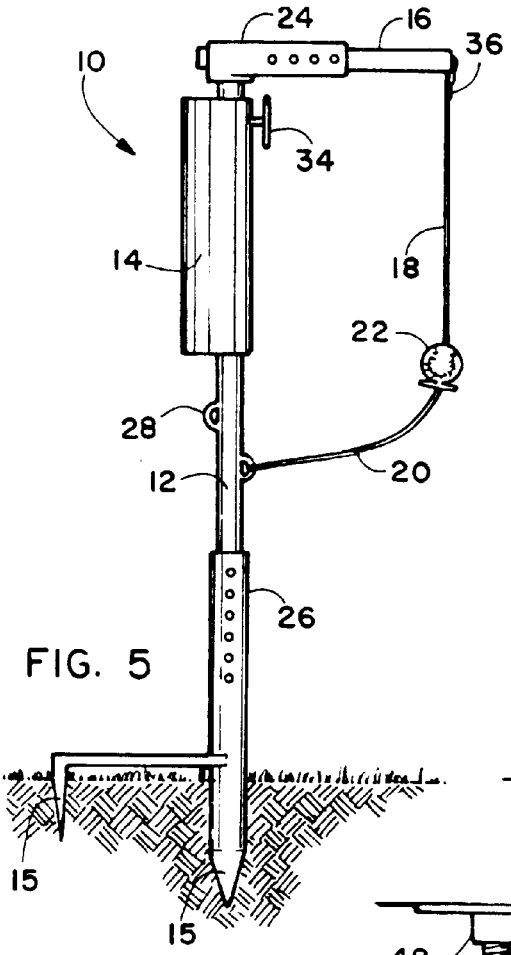

FIG. 5 depicts an embodiment of the device for use on a ground surface using mounting spikes.

Figure 6:
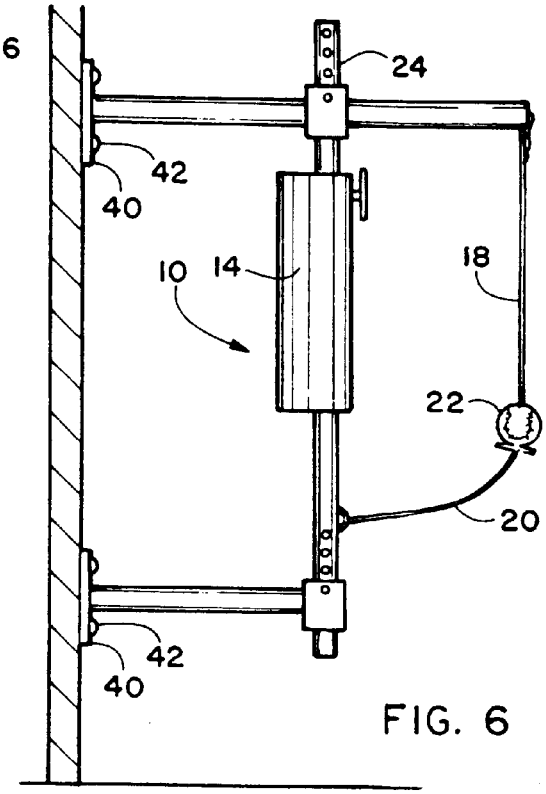

FIG. 6 is a side view of the device showing a wall mounted practice device with adjustment means to adapt to the height of a player.

Figure 7:
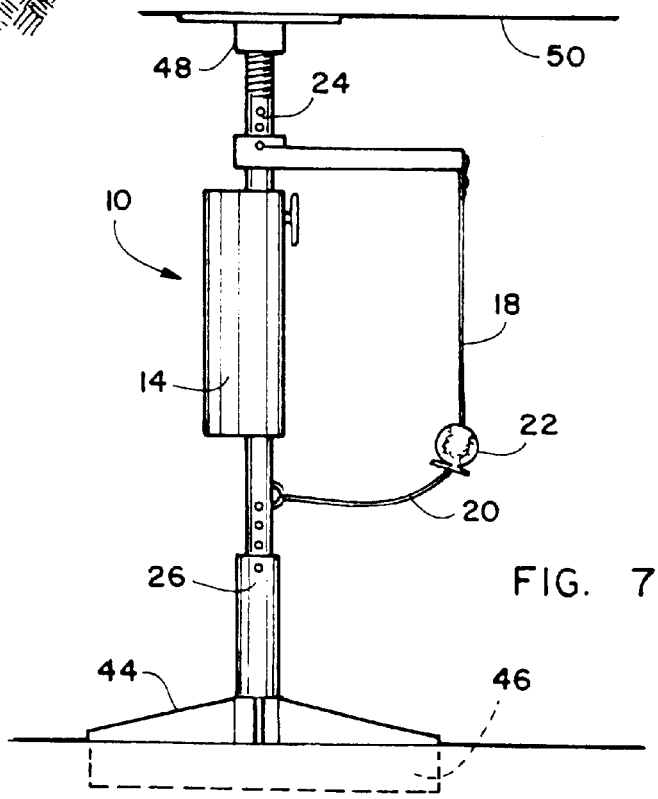

FIG. 7 is a view of the disclosed device which can either be bolted down over a concrete block or shored under the ceiling of a garage or other building overhangs.

DETAILED DESCRIPTION OF THE PREFERRED EMBODIMENTS OF THE INVENTION

Figure 1:
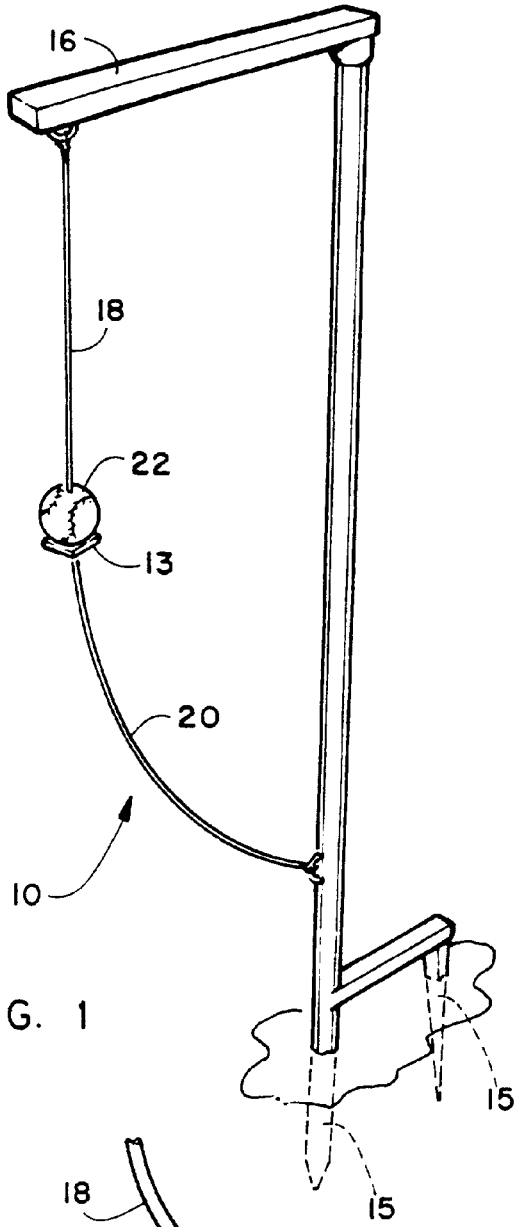
FIG. 1 depicts the device herein disclosed showing the ball slidably located on the tether adjacent to the stop.

Referring now to the drawing FIGS. 1–7 the device is depicted and disclosed in various preferred embodiments. FIG. 1 depicts an embodiment of the device 10 with the tether 18 attached to a tether support means which in this case features a tether mounting pole 16 which in turn attaches to a vertical pole 12. The tether 18 can be attached to the tether support means using a conventional means of attachment such as tying it to an eye bolt or placing a swag on the end of the tether which attaches to a properly configured mating attachment on the tether support means.

The vertical pole 12 of the device 10 may be permanently mounted in a fixed position at the base end 11, using a sleeved or cement type conventional mount to the ground, or in a portable mounting means such as a container 32 filled with sand or water or some other heavy material to provide a weighted base. Or as depicted in FIG. 3, one or a plurality of spikes 15 attached to the base end 11 may be driven into the mounting surface such as grass or soil. Or, as depicted in FIGS. 6 and 7 plates 40 can be attached to the base end 11 and the device 10 may be secured to a mounting surface using conventional bolts 42.

The tether 18 has an attachment end 36 for attaching the tether 18 to the tether support means on the tether mounting pole 16 attached to a vertical pole 12. The attachment of the tether 18 at the attachment end can be accomplished using swags or clips or other conventional mating attachments. The distal end 18*a* of the tether 18 provides a position at which the ball 22 locates for hitting by the user using the positioner 13 locateable on the distal end 18*a* of the tether 18 by the user. The tether 18 in the current best mode is made preferably of semi-elastic material such as that used for surfboard leashes as it provides a biasing effect once hit, thereby speeding the return the ball 22 to the hitting position when wrapped around the vertical pole 12 after the ball is hit by the user. The tether 18 provides an excellent slidable mount wherein the ball 22 may slide upon the exterior surface of the tether 18 when hit and when returning to the target position at the positioner 13. This slidable mounting of the ball 22 on the tether 18 causes the device to function better by absorbing some of the energy as well as allowing a better return of the ball to a target position suspended on the tether 18 adjacent to the positioner 13 substantially perpendicular to the ground or surface on which the support means is placed or mounted or parallel to the wall surface if wall mounted.

Allowing for a slidable mounting of the ball 22 also provides the user with the ability to adjust the target position of the ball 22 on the tether 18 in the current best mode. The positioner 13 can be mounted to the tether 18 either in a fixed position close or immediately adjacent to the distal end of the tether 18, however making the positioner 13 adjustable in a manner that allows the positioner 13 to remain in a user defined position on the tether 18 provides the most utility to the user.

When positioned on the tether 18 the positioner 13 determines the target position of the ball 22 by stopping the ball from sliding on the tether 18 when the tether 18 is in a vertical position attached to the support structure. The ball 22 thus slides back to and settle on the positioner 13 for hitting. Frictional engagement between an aperture 13*a* or other means of attachment of the positioner 13 to the tether 18 provides frictional engagement with the exterior of the tether 18 sufficient to hold the positioner 13 in a defined fixed position. If the positioner 13 is made from an elastic or plastic material, the aperture 13*a* would naturally have a propensity to grip the tether 18 and the amount of that grip or frictional engagement may be determined by the diameter of the aperture 13*a*.

Another embodiment of the ball positioner is depicted in FIG. 2*b* and in this embodiment the positioner 13 is formed of a material swag 17 from a plurality of layers of material such as webbing sewn using conventional stitching 19 or otherwise manufactured to the proper configuration to form two elongated passageways which frictionally engage the exterior of the tether 18. The tether 18 passes through a first passageway 17*a*, out of the material swag, and back though a second passageway 17*b*. The material swag 17 version of the positioner 13 thus forms a loop in tether 18 and the size and position of the loop on the tether 18 is adjustable by sliding the material swag 17 to different positions on the tether 18 and adding or subtracting from the size of the loop formed. The position of the ball is thus adjustable by changing the size of the loop by changing the position on the tether 18 at which the material swag 17 is frictionally engaged with the tether 18 through the parallel passageways 17*a* and 17*b* in the material swag 17.

The positioners 13 and material swag 17 are thus infinitely adjustable for position between the attachment of the tether 18 to the tether mounting pole 16 in place thereof and distal end 18*a* of the tether 18 providing an infinite number of target positions for the ball 22 when so adjusted by the user in this is the current best mode of the device 10. However, a fixed position of the positioner 13 might also be desirable in certain instances where no adjustment is desired such as areas of vandalism, and in such instances the positioner 13 could therein be glued or swagged or otherwise fixed to the tether 18 and such instances are anticipated.

An elongated biasing means in the form of a leash 20 is attached in the current best mode of the device and can be made from elongated biasing materials such as one or a combination of biasing means from a group consisting of rubber rope, elastic cord, and springs. The leash 20 may be a part of the tether 18 if made from elastic material such as a surfboard leash and defined by the portion of the leash 20 located below the positioner 13, or, it may be a separate piece attached to the distal end 18*a* of the tether 18 near positioners 13 or material swag 17. In the current best mode the leash 20 is part of the tether 18 attached at the distal end below the point where the positioners 13 or material swag 17 are mounted. However, if more or less ball return speed than can be provided by the elasticity of the material comprising the tether 18 is desired by the user, the leash 20 may be provided using elastic or other biasing material with more or less bias to produce the return speed desired, thus allowing the return speed of the ball to be further adjusted to user preference.

As depicted in FIG. 2 in the current best mode, the ball 22 is free to slide upward upon the tether 18 when hit by the user and when returning to target position determined by the positioner 13. This is accomplished by a slidable mounting of the ball on the tether 18 using a slot 21 traversing the center of the ball 22 and communicating therethrough. The slot 21 being slightly larger in diameter than that of the outside circumference of the tether 18 provides for a slidable location of the ball 22 on the tether 18. Once hit, the ball 22 will slide upward toward the attachment end of the tether 18 until constrained by wrapping around the vertical pole 12. The biasing provided by the elasticity of the tether 18 and the additional biasing from the leash 20 if used, pulls the ball 22, which has wound around the vertical pole 12 thus causing it to unwind from the vertical pole 12 and return to a target position adjacent to the positioner 13 with the tether 18 in a substantially perpendicular position to the ground or mounting surface. As noted, during the return the ball 22, slides downward on the tether 18, and relocates upon the positioner 13, ready to be hit again. By allowing for a slidably located ball 22 with no upward restraint on the ball 22 sliding on the tether 18, a means for shock absorption is thus provided to the device which helps relieve the impact of the bat 30 on the ball 22 when repeatedly struck as some of the force from the bat 30 is absorbed in the ball 22 sliding up the tether 18.

FIG. 4 depicts another preferred embodiment of the invention featuring the batting practice device 10 comprised of vertical pole 12 mounted in a portable fashion for use on the floor of a gymnasium. The vertical pole 12 as shown is adjustable and could be used in any embodiment and provides another means for adjustment of the target position of the ball 22 by using telescopically engaged pole sections to make the vertical pole 12 and/or the tether mounting pole 16. Using conventional pins 28 through passages, 24 in the telescopically sectioned pole 13 and/or tether mounting pole 16 or other conventional means of engaging the plurality of sections making up the telescopically sectioned pole 12 and/or tether mounting pole 16, either can be elongated to different lengths. This allows for the ball 22 to be positioned further away or closer to the mounting surface, and/or further or closer to the vertical pole 12, thus changing the target position of the ball 22 as the user may desire.

Another optional part of the best embodiment provided a means of adjustment of the return speed of the ball 22 once struck, using a cam 14 on the exterior of the vertical pole 12. The cam 14 consists of a rotatably mounted second vertical pipe 38, enclosing first vertical pole 12. The cam is rotatable off center of the cam interior around the axis of the first vertical pole 12 thus acting as an eccentric for the tether 18 to wind around.

FIG. 3 is a top plan view of a batter using the practice device 10. This illustrates the spiral path of the ball 22 around the pole 12 and with the tether 18 being of such a length and secured at a point on said tether mounting pole 16 such that its length will be substantially greater than the distance between the point at which the tether 18 is secured to the tether mounting pole 16 and said distance to the cam 14. The ball 22 is suspended above the ground at a height appropriate for the height of the batter. The ball 22 is to be struck by a striking means such as a bat 30 or, if used for tennis or similar sports, a racket, and then follows a generally spiral path about the vertical pole 12. In following the spiral path around the pole 12, the tether 18 and leash 20 are wound about the cam 14 which is rotatably mounted upon the vertical pole 12, until the ball 22 reaches fully winds the tethers and rebounds from the cam 14. The ball 22 thereafter substantially retraces the spiral path back toward the point of bat impact ready to be hit again when it returns to the target position. This is the same operation in the device in FIG. 1 wherein the ball 22 winds around the vertical pole 12 as in this embodiment where a cam 14 is present. In all instances the ball 22 is aided in its return to a target position by the biasing means provided by the tether 18 if elastic material, and if attached the leash 20 or the tether 18 by itself if it forms both the tether 18 and leash 20.

FIG. 5 is an illustrative cross-sectional view of the vertical elevation showing an outdoor ground-mounted batting practice device of the second embodiment of the invention. The cam 14 may be adjusted around the vertical pole 12 axis, thus defining and fine-tuning the speed of return of the ball. This figure also illustrates the telescopic piping used to form vertical pole 12 for adjusting the height of the device to different size people. The device 10 in this embodiment shows a plurality of spikes 15 for driving into the ground.

FIG. 6 is a view showing a wall mounted practice device with telescopic adjustment means 24 to adapt to the height of a player; the device is mounted to the wall by means of mounting plates 40 and bolts 42

FIG. 7 is a stationary embodiment of the invention having a telescopic support pole 26 welded to a flange 44 for positioning and bolting the device over a concrete block. Another embodiment of the same invention comprises a shoring means 48 to secure the vertical pole against the ceiling of a garage or other building overhangs 50. It shows the cam 14 but as with all embodiments of the device, would also function quite well with just the vertical pole 12 should the additional adjustment provided by the cam 14 not be desired.

While all of the fundamental characteristics and features of the Baseball Striking Practice Device herein disclosed have been shown and described, it should be understood that various substitutions, modifications, and variations may be made by those skilled in the art without departing from the spirit or scope of the invention. Consequently, all such modifications and variations are included within the scope of the invention as defined by the following claims.

What is claimed is:

1. A ball hitting practice device comprising a ball, said ball slidably mounted upon a tether, said tether having an attachment end and having a distal end;

a tether support means, said tether support means mountable at a base end on a mounting surface;

means of attachment of said attachment of said tether to said tether support means whereby said tether is positioned substantially normal to said mounting surface when attached to said tether support means;

a ball positioner mounted upon said tether proximate to said distal end of said tether;

said ball positioner providing a stop for said slidably mounted ball thereby determining a target position for said ball when said ball slides to a position adjacent to said ball positioner;

whereby said practice ball in said target position when struck by a user will slide on said tether and wrap around said tether support means and thereafter return to said target position.

2. The device as defined in claim 1 further comprising:

a means for frictional engagement of said ball positioner with said tether thereby rendering said ball positioner slidably mountable to said tether at an infinite number of positions between said attachment end and said distal end; and said ball positioner thereby determining an infinite number of locations for said target position for said ball by sliding said ball positioner to one of said positions and releasing it, wherafter it will remain frictionally engaged with said tether.

3. The device as defined in claim 1 further comprising:

an elongated biasing means, said elongated biasing means attachable at one end to said distal end of said tether and at an opposite end to a fixed mount, said elongated biasing means providing a bias to aid the return of said practice ball to said target position once struck by the user.

4. The device as defined in claim 2 further comprising:

an elongated biasing means, said elongated biasing means attachable at one end to said distal end of said tether and at an opposite end to a fixed mount, said elongated biasing means providing a bias to aid the return of said practice ball to said target position once struck by the user.

5. The device as defined in claim 1 wherein said tether support means comprises:

a vertical pole attachable at one end to a mount said mount positionable on said mounting surface;

a tether mounting pole attached at an opposite end of said vertical pole, said tether mounting pole providing a mounting point for said means of attachment of said tether.

6. The device as define in claim 5 further comprising:

a means for adjustment of the height of said tether mounting pole above the mounting surface.

7. The device as defined in claim 6 further comprising:

means for adjustment of said target position of said ball above the mounting surface, said means for adjustment of said target position consisting of adjustment to one or both of a group of target position adjustment means consisting of said means for adjustment of the height of said tether mounting pole and said means for frictional engagement of said ball positioner upon said tether.

8. The device as defined in claim 6 wherein said means for adjustment of the height of said tether mounting pole is provided by said vertical pole formed from a plurality of telescopically engaged pole sections.

9. The device as defined in claim 2 wherein said means for frictional engagement with said tether comprises:

said ball positioner comprised of elastic material; and an aperture formed in said ball positioners said aperture being of a diameter whereby said elastic material compresses said aperture upon said tether.

10. The device as defined in claim 2 wherein said means for frictional engagement with said tether comprises:

a material swag;

a first passageway and a second passageway formed in said material swag;

said tether threadable through said first passageway and exiting at an exit aperture in said first passageway;

said tether threadable trough said second passageway through and entry aperture adjacent to said exit aperture;

said material swag frictionally engaging said tether within both said first and second passageways;

a loop formed between said exit aperture an said entry aperture, said ball slidably locateable in said loop; and whereby the size and the position of said loop in said tether may be determined by sliding said tether to varying positions in one or both of said first and second passageways.

11. The device as defined n claim 3 wherein said elongated biasing means is one or a combination of biasing means from a group consisting of rubber rope, elastic cord, and springs.

12. The device as defined in claim 4 wherein said elongated biasing means is one or a combination of biasing means from a group consisting of rubber rope, elastic cord, and springs.

13. The device as defined in claim 4 wherein said elongated biasing means is formed from a section of said tether.

14. The device as defined in claim 1 wherein said base end comprises one or a plurality of spikes attached to said vertical pole, said spikes dimensioned for driving into said mounting surface.

15. The device as defined in claim 1 wherein said base end is attachable to a weighted base, said weighted base positionable on said mounting surface.

16. The device as defined in claim 1 wherein said base end is configured for attachment to a wall surface using a wall mount attached thereto.

17. The device as defined in claim 1 further comprising:

a means for return speed adjustment comprising a cam;

said cam rotatably mounted upon the exterior of said vertical pole; and whereby the speed of return of said ball to said target position subsequent to being struck by said user may be adjusted by rotation of said cam on said vertical pole.

18. The device as defined in claim 3 wherein said elongated biasing means additionally functions as a second means for return speed adjustment whereby varying the biasing force of said elongated biasing means will vary the speed of return of said ball to said target position.

* * * * *